US008051911B2

(12) United States Patent
Brannon

(10) Patent No.: US 8,051,911 B2
(45) Date of Patent: Nov. 8, 2011

(54) METHOD OF FRACTURING A SUBTERRANEAN FORMATION AT OPTIMIZED AND PRE-DETERMINED CONDITIONS

(75) Inventor: Harold Dean Brannon, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/688,959

(22) Filed: Jan. 18, 2010

(65) Prior Publication Data

US 2010/0116500 A1 May 13, 2010

Related U.S. Application Data

(62) Division of application No. 11/706,033, filed on Feb. 13, 2007, now Pat. No. 7,669,655.

(51) Int. Cl.
*E21B 43/26* (2006.01)
*E21B 47/00* (2006.01)

(52) U.S. Cl. ..... 166/250.1; 166/280.1; 166/308.1

(58) Field of Classification Search ..... None
See application file for complete search history.

(56) References Cited

U.S. PATENT DOCUMENTS 4,220,205 A 9/1980 Coursen et al. ..... 166/299
5,425,421 A * 6/1995 Coleman et al. ..... 166/250.14
6,876,959 B1 4/2005 Peirce et al. ..... 703/10

OTHER PUBLICATIONS

Biot et al, "Theory of Sand Transport in Thin Fluids", SPE 14468, Sep. 1985.
Brannon et al, "Large Scale Laboratory Investigation of the Effects of Proppant and Fracturing Fluid Properties on Transport", SPE 98005, Feb. 2006.
Brannon et al, The Quest for Improved Proppant Placement: Investigation of the Effects of Proppant Slurry Component Properties on Transport:, SPE 95675, Oct. 2005.
Brannon et al, "A New Correlation for Relating the Physical Properties of Fracturing Slurries to the Minimum Flow Velocity Required for Transport", SPE 106312, Jan. 2007.
Rickards et al, "High Strength, Ultra-Lightweight Proppant Lends New Dimensions to Hydraulic Fracturing Applications", SPE 84308, Oct. 2003.
Wood et al, "Ultra-Lightweight Proppant Development Yields Exciting New Opportunities in Hydraulic Fracturing Design", SPE 84309, Oct. 2003.
Brannon et al, "Maximizing Facture Conductivity with Partial Monolayers: Theoretical Curiosity or Highly Productive Reality", SPE 90698, Sep. 2004.
Brannon et al, "Improved Understanding of Proppant Transport Yields New Insight to the Design and Placement of Fracturing Treatments", SPE 102758, Sep. 2006.

* cited by examiner

*Primary Examiner* — Zakiya W Bates
(74) *Attorney, Agent, or Firm* — John Wilson Jones; Jones & Smith, LLP

(57) ABSTRACT

Prior to a hydraulic fracturing treatment, the requisite injection rate for a desired propped fracture length of a fracture may be estimated with knowledge of certain physical properties of the proppant and transport fluid such as fluid viscosity, proppant size and specific gravity of the transport slurry as well as fracture geometry and the fracture length.

4 Claims, 1 Drawing Sheet

METHOD OF FRACTURING A SUBTERRANEAN FORMATION AT OPTIMIZED AND PRE-DETERMINED CONDITIONS

The present application is a divisional application of U.S. patent application Ser. No. 11/706,033, filed on 13 Feb. 2007, the entire disclosure of the foregoing application being incorporated herein by reference.

FIELD OF THE INVENTION

A method of optimizing variables affecting stimulation treatments in order to improve well productivity is disclosed.

BACKGROUND OF THE INVENTION

In a typical hydraulic fracturing treatment, fracturing treatment fluid comprising a transport slurry containing a solid proppant, such as sand, is injected into the wellbore at high pressures.

The transport of sand, as proppant, was examined in Biot and Medlin, "Theory of Sand Transport in Thin Fluids", SPE 14468, Sep. 22-25, 1985, which is herein incorporated by reference. In Biot-Medlin, it was determined that the mechanics of sand transport are principally controlled by horizontal fluid velocity, U, of the transport fluid containing the proppant (transport slurry). The velocity ranges for transport mechanisms were defined in terms of the ratio $v_t/U$ as follows:

$v_t/U>0.9$ Transport by rolling or sliding;

$v_t/U\approx0.9$ Critical condition of pick-up;

$0.9>v_t/U>0.1$ Bed Load transport;

$v_t/U<0.1$ Suspension transport wherein $V_t$ is the terminal settling velocity for the transport slurry. Thus, at very low velocities, proppant moves only by sliding or rolling. The upper limit of this range is determined by a critical proppant pick-up velocity. At intermediate velocities, a fluidized layer is formed to provide bed load transport. At high velocities, proppant is carried by suspension within the transport fluid.

Once natural reservoir pressures are exceeded, the fluid induces fractures in the formation and proppant is placed in the created fractures to ensure that the fractures remain open once the treating pressure is relieved. Highly conductive pathways, radiating laterally away from the wellbore, are thereby provided to increase the productivity of oil or gas well completion. The conductive fracture area is defined by the propped fracture height and the effective fracture length.

In the last years, considerable interest has been generated in recently developed ultra-lightweight (ULW) proppants which have the requisite mechanical properties to function as a fracturing proppant at reservoir temperature and stress conditions. Hydraulic fracturing treatments employing the ULW proppants have often resulted in stimulated well productivity well beyond expectations. ULW proppants are believed to facilitate improved proppant placement, thus providing for significantly larger effective fracture area than can be achieved with previous fluid/proppant systems. Improvements in productivity have been attributable to the increased effective fracture area from use of such ULW proppants.

In light of cost economics, there has also recently been a renewed interest in slickwater fracturing which uses relatively non-damaging fracturing fluids. The most significant disadvantage associated with slickwater fracturing is poor proppant transportability afforded by the low viscosity treating fluid. Poor proppant transport results in the tendency of proppants to settle rapidly, often below the target zone, yielding relatively short effective fracture lengths and consequently, steeper post-stimulation production declines than may be desired. Post-frac production analyses frequently suggests that effective fracture area, defined by the propped fracture height and the effective fracture length, is significantly less than that designed, implying either the existence of excessive proppant-pack damage or that the proppant was not placed in designated areal location.

Three primary mechanisms work against the proper placement of proppant within the productive zone to achieve desired effective fracture area. First, fracture height typically develops beyond the boundaries of the productive zone, thereby diverting portions of the transport slurry into non-productive areas. As a result, the amount of proppant placed in the productive area may be reduced. Second, there exists a tendency for the proppant to settle during the pumping operation or prior to confinement by fracture closure following the treatment, potentially into non-productive areas. As a result, the amount of proppant placed in productive areas is decreased. Third, damage to the proppant pack placed within the productive zone often results from residual fluid components. This causes decreased conductivity of the proppant pack.

Efforts to provide improved effective fracture area have traditionally focused on the proppant transport and fracture clean-up attributes of fracturing fluid systems. Still, the mechanics of proppant transport are generally not well understood. As a result, introduction of the transport slurry into the formation typically is addressed with increased fluid viscosity and/or increased pumping rates, both of which have effects on fracture height containment and conductivity damage. As a result, optimized effective fracture area is generally not attained.

It is desirable to develop a model by which proppant transport can be regulated prior to introduction of the transport slurry (containing proppant) into the formation. In particular, since well productivity is directly related to the effective fracture area, a method of determining and/or estimating the propped fracture length and proppant transport variables is desired. It would further be highly desirable that such model be applicable with ULW proppants as well as non-damaging fracturing fluids, such as slickwater.

SUMMARY OF THE INVENTION

Prior to the start of a hydraulic fracturing treatment process, the relationship between physical properties of the selected transport fluid and selected proppant, the minimum horizontal velocity, $MHV_{ST}$, for transport of the transport slurry and the lateral distance to which that minimum horizontal velocity may be satisfied, are determined for a fracture of defined generalized geometry.

The method requires the pre-determination of the following variables:

(1) the $MHV_{ST}$;

(2) a Slurry Properties Index, $I_{SP}$; and (3) characterization of the horizontal velocity within the hydraulic fracture.

From such information, the propped fracture length of the treatment process may be accurately estimated.

The minimum horizontal flow velocity, $MHV_{ST}$, for suspension transport is based upon the terminal settling velocity, $V_t$, of a particular proppant suspended in a particular fluid and may be determined in accordance with Equation (I):

$$MHV_{ST}=V_t\times10 \quad (I)$$

Equation (I) is based on the analysis of Biot-Medlin which defines suspension transport as $V_t/U<0.1$, wherein U is horizontal velocity.

For a given proppant and transport fluid, a Slurry Properties Index, $I_{SP}$, defines the physical properties of the transport slurry as set forth in Equation (II):

$$I_{SP}=(d^2_{prop})\times(1/\mu_{fluid})\times(\Delta SG_{PS}) \quad \text{(II)}$$

wherein:

$d_{prop}$ is the median proppant diameter, in mm.;

$\mu_{fluid}$ is the apparent viscosity of the transport fluid, in cP; and $\Delta SG_{PS}$ is $SG_{prop}-SG_{fluid}$, $SG_{prop}$ being the specific gravity of the proppant and $SG_{fluid}$ being the specific gravity of the transport fluid.

With knowledge of the $MHV_{ST}$ for several slurries of various fluid and proppant compositions, $C_{TRANS}$, a transport coefficient may be determined as the slope of the linear regression of $I_{SP}$ vs. $MHV_{ST}$, in accordance with Equation (III):

$$MHV_{ST}=C_{TRANS}\times I_{SP} \quad \text{(III)}$$

The horizontal velocity, U and the generalized geometry of the fracture to be created are used to determine power law variables. This may be calculated from a generalized geometric fracture model required for proppant transport. Similar information can be extracted from some fracture design models, such as Mfrac. The generalized fracture geometry is defined by the aspect ratio, i.e., fracture length growth to fracture height growth. A curve is generated of the velocity decay of the transport slurry versus the fracture length by monitoring fracture growth progression from the instantaneous change in the major radii of the fracture shape.

As an example, where the aspect ratio is 1:1, the horizontal direction of the radial fracture may be examined. The instantaneous change in the major radii over the course of the simulation is used as a proxy for fluid velocity at the tip of the fracture. Using the volumes calculated for each geometric growth increment, the average velocities to satisfy the respective increments may then be determined. For instance, growth progression within the fracture may be conducted in 100 foot horizontal length increments. A transport slurry velocity decay versus fracture length curve is generated wherein the average incremental values are plotted for the defined generalized geometry versus the lateral distance from the wellbore.

A power law fit is then applied to the decay curve. This allows for calculation of the horizontal velocity at any distance from the wellbore. The multiplier, A, from the power law equation describing the transport slurry velocity vs. distance for the desired geometry is then determined. The exponent, B, from the power law equation describing the transport slurry velocity vs. distance for the desired geometry is also determined.

The length of a propped fracture, $D_{PST}$, may then be estimated for a fracturing job with knowledge of multiplier A and exponent B as well as the injection rate and $I_{SP}$ in accordance with Equation (IVA and IVB):

$$(D_{PST})^B=q_i\times(1/A)\times C_{TRANS}\times I_{SP}; \text{ or} \quad \text{(IVA)}$$

$$(D_{PST})^B=q_i\times(1/A)\times C_{TRANS}\times(d^2_{prop})\times(1/\mu_{fluid})\times\Delta SG_{PS}) \quad \text{(IVB)}$$

wherein:

A is the multiplier from the Power Law equation describing the transport slurry velocity vs. distance for the generalized fracture geometry;

B is the exponent from the Power Law equation describing the transport slurry velocity vs. distance for the generalized fracture geometry;

$q_i$ is the injection rate per foot of injection height, bpm/ft.; and $C_{TRANS}$; the transport coefficient, is the slope of the linear regression of the $I_{SP}$ vs $MHV_{ST}$.

$D_{PST}$ is thus the estimated propped fracture length which will result from a fracturing treatment using the predetermined variables.

Via rearrangement of Equation (IVB), treatment design optimization can be obtained for other variables of the proppant, transport fluid or injection rate. In particular, prior to introducing a transport slurry into a fracture having a defined generalized geometry, any of the following parameters may be optimized:

(a) the requisite injection rate for a desired propped fracture length, in accordance with the Equation (V):

$$q_i=[1/(D_{PST})^B]\times[(1/A)\times C_{TRANS}\times(d^2_{prop})\times(1/\mu_{fluid})\times(\Delta SG_{PS})]; \quad \text{(V)}$$

(b) $\Delta SG_{PS}$ for the desired propped fracture length in accordance with Equation (VI):

$$\Delta SG_{PS}=(A)\times(1/q_i)\times(D_{PST})^B\times(1/C_{TRANS})\times(1/d^2_{prop})\times(\mu_{fluid}) \quad \text{(VI);}$$

(c) the requisite apparent viscosity of the transport fluid for a desired propped fracture length in accordance with Equation (VII):

$$\mu_{fluid}=(1/A)\times q_i\times(1/D_{PST})^B\times(C_{TRANS})\times(\Delta SG_{PS})\times(d^2_{prop}); \quad \text{(VII); and}$$

(d) the requisite median diameter of a proppant, $d_{prop}$, for the desired propped fracture length in accordance with Equation (VIII):

$$(d_{prop})^2=(A)\times(1/q_i)\times(D_{PST})^B\times(1/C_{TRANS})\times(1/\Delta SG_{PS})\times(\mu_{fluid}) \quad \text{(VIII)}$$

BRIEF DESCRIPTION OF THE DRAWINGS

In order to more fully understand the drawings referred to in the detailed description of the present invention, a brief description of each drawing is presented, in which.

DETAILED DESCRIPTION OF THE PREFERRED EMBODIMENTS

Figure 1:
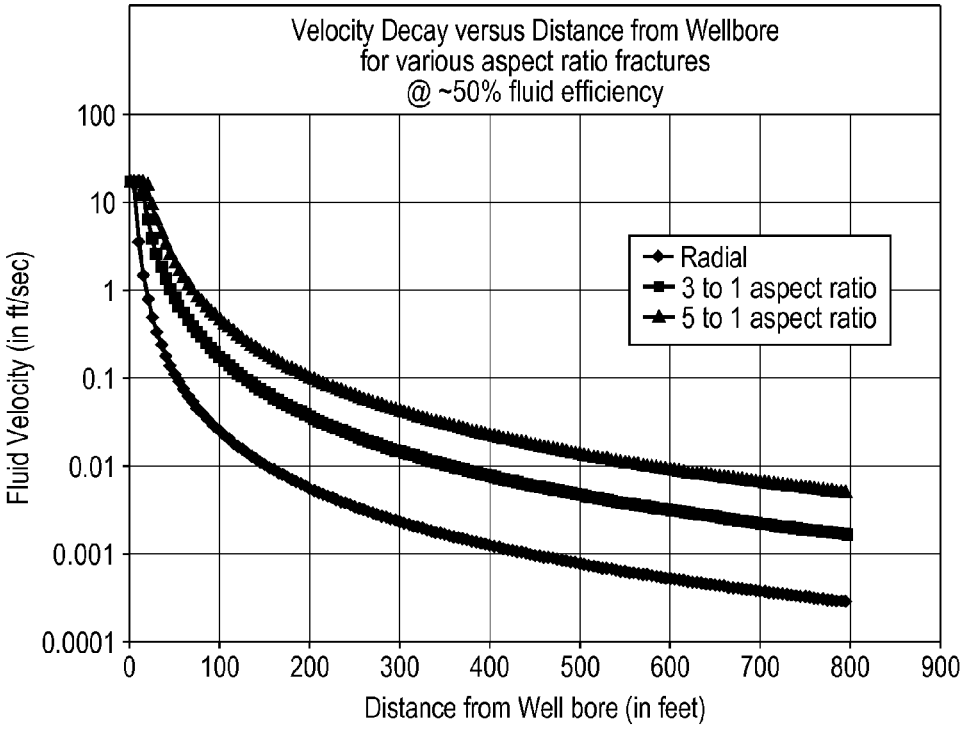
FIG. 1 is a plot of velocity decay of a transport slurry containing a proppant vs. distance from the wellbore for three different fracture geometries using an injection rate of 10 bpm and 10 ft of height at a wellbore velocity 17.1 ft/sec at the wellbore.

Certain physical properties of proppant and transport fluid affect the ability of the proppant to be transported into a subterranean formation in a hydraulic fracturing treatment. Such properties include the median diameter of the proppant, specific gravity of the proppant and the apparent viscosity and specific gravity of the fluid used to transport the proppant into the formation ("transport fluid").

A Slurry Properties Index, $I_{SP}$, has been developed to define the inherent physical properties of the transport slurry (transport fluid plus proppant):

$$I_{SP}=(d^2_{prop})\times(1/\mu_{fluid})\times(\Delta SG_{PS}) \quad \text{(I)}$$

wherein:

$d_{prop}$ is the median proppant diameter, in mm.;

$\mu_{fluid}$ is the apparent viscosity of the transport fluid, in cP; and $\Delta SG_{PS}$ is $SG_{prop}-SG_{fluid}$, $SG_{prop}$ being the specific gravity of the proppant and $SG_{fluid}$ being the specific gravity of the transport fluid.

As an example, the $I_{SP}$ for sand having a specific gravity of 2.65 g/cc and specific gravity of the transport fluid being 8.34 lbs/gallon (1 g/cc), a median diameter of sand of 0.635 mm and an apparent viscosity of 7 cP for the transport fluid would be:

$$I_{SP}=(1150)(0.635^2)\times(1/7)\times(2.65-1.0)=109.3$$

wherein the 1150 multiplier is a unit conversion factor.

Thus, an increase in $I_{SP}$ translates to an increased difficulty in proppant transport. As illustrated in Equation (I), the proppant size very strongly influences the ISP. Since the median diameter of the proppant is squared, increasing proppant size results in a relatively large increase in the $I_{SP}$ index. Since the fluid viscosity, $\mu_{fluid}$, is in the denominator of Equation (I), an increase in fluid viscosity translates to a reduction in $I_{SP}$. This results in a proportional improvement in proppant transport capability. Further, an increase in $\Delta SG_{PS}$, the differential in specific gravity between the proppant and the transport fluid, created, for instance, by use of a heavier proppant and/or lighter transport fluid, translates into a proportional decrease in proppant transport capability. The $I_{SP}$, defined in Equation (1) may be used to describe any proppant/fluid combination by its inherent properties.

The $I_{SP}$ may be used to determine the lateral distance that a given transport slurry may be carried into a fracture. This lateral distance is referred to as the effective fracture length. The effective fracture length may further be defined as the lateral distance into a given fracture at which the minimum velocity for suspension transport is no longer satisfied, wherein the minimum velocity is represented as $V_t/U<0.1$. [Bed load transport ($V_t/U>0.1$) is generally not considered capable of providing sufficient lateral proppant transport for significant extension of propped fracture length.]

Thus, the effective fracture length is dependent on the terminal settling velocity, $V_t$. $V_t$, as reported by Biot-Medlin, is defined by the equation:

$$V_t=2[(\rho_p-\rho)/3\rho C_d\times gd]^{1/2}$$

wherein:

$\rho_p$ is the density of proppant;

$\rho$ is the density of the transport fluid;

$C_d$ is the drag coefficient;

d is the diameter of the proppant; and g is acceleration due to gravity.

There is a large body of published data for $V_t$ for proppants in both Newtonian and non-Newtonian liquids.

Horizontal fluid velocity, U, within the growing hydraulic fracture is dependent upon the injection rate as well as fracture geometry. The fracture geometry is defined by the aspect ratio, i.e., fracture length growth to fracture height growth. For example a 1:1 aspect ratio is radial and a 3:1 and 5:1 aspect ratio is an elliptical growth pattern. As the fracture is created and growth in length and height proceeds, it is possible to calculate (with knowledge of the velocity of the fluid and the time required to fill the fracture) the volume of fluid which fills the fracture. The volume for geometric growth increments may therefore be determined.

Fracture growth progression may be monitored from the changes in the major radii of the fracture shape. Using the volumes calculated for each geometric growth increment, the average horizontal velocity, U, to satisfy the respective increments may then be determined.

For instance, using an aspect ratio of 1:1, the horizontal direction of the radial fracture may be examined wherein growth progression within the fracture is conducted in 100 foot horizontal length increments using a model fracture width maintained at a constant ¼" throughout the created geometry. To account for fluid loss, a fluid efficiency factor may be applied. A typical fluid efficiency factor is 50%. The transport slurry injection was modeled using an initial height of 10 feet and a 10 bpm/min fluid injection rate (i.e. 1 bpm/ft of injection height). These values resulted in 17.1 ft/sec horizontal velocity at the wellbore. Fracture growth progression may be conducted in 100 foot horizontal length increments and may be monitored by the instantaneous change in the major radii of the fracture shapes (the horizontal direction in the case of the radial fracture simulation). The instantaneous change in the major radii over the course of the simulation was used as a proxy for fluid velocity at the tip of the fracture. Using the volumes calculated for each geometric growth increment, the average velocities to satisfy the respective increments may then be determined.

A transport slurry velocity decay versus fracture length curve may be generated wherein the average incremental values are plotted for the defined generalized geometry versus the lateral distance from the wellbore. The resultant curve is a plot of velocity decay of the transport slurry versus the fracture length. The decay in horizontal velocity versus lateral distance from the wellbore for fracture geometries having aspect ratios of 1:1 (radial), 3:1 (elliptical) and 5:1 (elliptical) are illustrated in FIG. 1. As illustrated, the most severe velocity decay may be observed with the radial geometry, wherein the horizontal velocity at a distance of 100 ft was reduced by over 99.9% to 0.02 ft/sec, compared to the 17.1 ft/sec velocity at the wellbore. The greater the length to height ratio, the less severe the velocity decay observed. For instance, for the 5:1 elliptical model, the velocity decay was observed to be 97% in the initial 100 feet, resulting in an average horizontal velocity of 0.47 ft/sec.

Power law fits may then be applied to the decay curves, allowing for calculation of the horizontal velocity at any distance from the wellbore. Thus, the model defined herein uses the horizontal velocity of the fluid, U, and the geometry of the fracture to be created in order to determine power law variables. Such power law variables may then be used to estimate the propped fracture length using known transport slurry. The multiplier from the power law equation describing the velocity of the transport slurry vs. distance for the desired geometry for the 1:1 and 3:1 aspect ratios was 512.5 and 5261.7, respectively. The exponents from the power law equation describing the velocity of transport slurry vs. distance for the desired geometry for the 1:1 and 3:1 aspect ratios was −2.1583 and −2.2412, respectively.

The minimum horizontal flow velocity, $MHV_{ST}$, necessary for suspension transport is based on the terminal settling velocity, $V_t$, of a proppant suspended in a transport fluid and may be defined as the velocity, U, at which a plot of $V_t/U$ vs. U crosses 0.1 on the y-axis. Thus, $MHV_{ST}$ may be represented as follows:

$$MHV_{ST}=V_t\times 10 \quad (I)$$

Equation (I) properly defines the $MHV_{ST}$ for all proppant/transport fluids.

To determine the $MHV_{ST}$ of a transport fluid containing a proppant, a linear best fit of measured $I_{SP}$ versus their respective $MHV_{ST}$ ($v_t$ times 10) may be obtained, as set forth in Table I below:

TABLE I

| $SG_{prop}$ | $d_{prop}^2$ ($mm^2$) | $SG_{fluid}$ | $\mu_{fluid}$, cP | Slurry Properties Index, $I_{SP}$ | $MHV_{ST}$ |
|---|---|---|---|---|---|
| 2.65 | 0.4032 | 8.34 | 7 | 109.30 | 1.279 |
| 2.65 | 0.4032 | 8.34 | 10 | 76.51 | 0.895 |
| 2.65 | 0.4032 | 8.34 | 29 | 26.38 | 0.309 |
| 2.65 | 0.4032 | 8.34 | 26 | 29.43 | 0.344 |
| 2.65 | 0.4032 | 8.34 | 60 | 12.75 | 0.149 |
| 2.65 | 0.4032 | 9.4 | 7 | 100.88 | 1.180 |
| 2.65 | 0.4032 | 9.4 | 29 | 24.35 | 0.285 |
| 2.65 | 0.4032 | 9.4 | 6 | 117.69 | 1.377 |
| 2.65 | 0.4032 | 10.1 | 5 | 133.44 | 1.561 |
| 2.65 | 2.070 | 8.34 | 26 | 151.07 | 1.768 |
| 2.65 | 2.070 | 8.34 | 60 | 65.46 | 0.766 |
| 2.02 | 0.380 | 8.34 | 9 | 49.53 | 0.579 |
| 2.02 | 0.380 | 8.34 | 9 | 49.53 | 0.579 |
| 2.02 | 0.380 | 8.34 | 7 | 63.68 | 0.745 |
| 2.02 | 0.380 | 8.34 | 26 | 17.14 | 0.201 |
| 2.02 | 0.380 | 8.34 | 29 | 15.37 | 0.180 |
| 2.02 | 0.380 | 8.34 | 60 | 7.43 | 0.087 |
| 2.02 | 0.380 | 9.4 | 7 | 55.74 | 0.652 |
| 2.02 | 0.380 | 9.4 | 6 | 65.03 | 0.761 |
| 2.02 | 0.380 | 9.4 | 29 | 13.46 | 0.157 |
| 2.02 | 0.380 | 10.1 | 7 | 50.50 | 0.591 |
| 1.25 | 0.4264 | 8.34 | 60 | 2.04 | 0.024 |
| 1.25 | 0.4264 | 8.34 | 7 | 17.51 | 0.205 |
| 1.25 | 0.4264 | 8.34 | 11 | 11.14 | 0.130 |
| 1.25 | 0.4264 | 8.34 | 29 | 4.23 | 0.049 |
| 1.25 | 0.4264 | 9.4 | 8 | 7.53 | 0.088 |
| 1.25 | 0.4264 | 9.4 | 7 | 8.61 | 0.101 |
| 1.25 | 0.4264 | 9.4 | 29 | 2.08 | 0.024 |
| 1.25 | 4.752 | 8.34 | 6 | 227.70 | 2.664 |
| 1.25 | 4.752 | 8.34 | 27 | 50.60 | 0.592 |
| 1.08 | 0.5810 | 8.34 | 5 | 10.69 | 0.125 |
| 1.08 | 0.5810 | 8.34 | 8 | 6.68 | 0.078 |
| 1.08 | 0.5810 | 8.34 | 29 | 1.84 | 0.022 |

Figure 2:
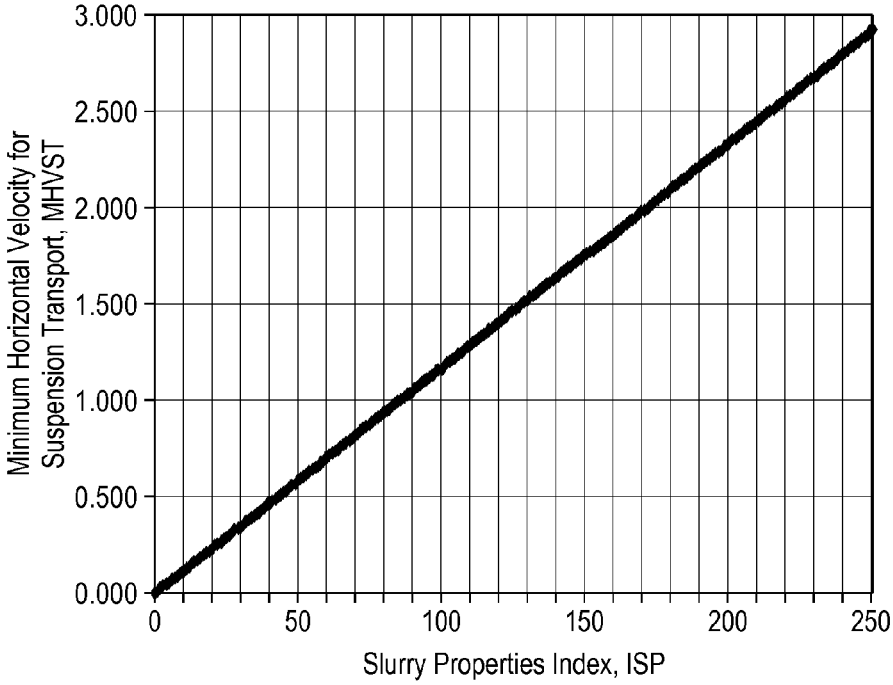
FIG. 2 is a plot of minimum horizontal flow velocity, $MHV_{ST}$, for a transport slurry and the Slurry Properties Index, $I_{SP}$.

FIG. 2 is an illustration of the plot of the data set forth in Table 1. The transport coefficient, $C_{TRANS}$, of the data may then be defined as the slope of the linear regression of the $I_{SP}$ vs $MHV_{ST}$ for any transport fluid/proppant composition. The $C_{TRANS}$ may be described by the equation:

$$MHV_{ST} = C_{TRANS} \times I_{SP}; \text{ or} \quad \text{(III)}$$
$$MHV_{ST} = C_{Trans} \times d_{prop}^2 \times 1/\mu_{fluid} \times \Delta SG_{PS}; \text{ or}$$

$$MHV_{ST} = V_t \times 10; \text{ or} \quad \text{(II)}$$
$$MHV_{ST} = C_{Trans} \times I_{SP}$$

wherein:

$MHV_{ST}$=Minimum Horizontal Velocity for the Transport Fluid;

$C_{TRANS}$=Transport Coefficient $I_{SP}$=Slurry Properties Index $d_{prop}$=Median Proppant Diameter, in mm.

$\mu_{fluid}$=Apparent Viscosity, in cP $\Delta SG_{PS}=SG_{prop}-SG_{fluid}$ $V_t$=Terminal Settling Velocity The plotted data is set forth in FIG. 2. For the data provided in Table 1 and the plot of FIG. 2, the equation for the linear best fit of the data may be defined as y=(0.0117)×thus, $C_{TRANS}$=0.0117. Insertion of the $C_{TRANS}$ value into Equation 2 therefore renders a simplified expression to determine the minimum horizontal velocity for any transport slurry having an aspect ratio of 1:1 or 3:1.

An empirical proppant transport model may then be developed to predict propped fracture length from the fluid and proppant material properties, the injection rate, and the fracture geometry. Utilizing the geometric velocity decay model set forth above, propped fracture length, $D_{PST}$, may be determined prior to the onset of a hydraulic fracturing procedure by knowing the mechanical parameters of the pumping treatment and the physical properties of the transport slurry, such as $I_{SP}$ and $MHV_{ST}$. The estimated propped fracture length of a desired fracture, $D_{PST}$, is proportional to the ISP, and may be represented as set forth in Equations IVA and IVB:

$$(D_{PST})^B = (q_i) \times (1/A) \times C_{TRANS} \times I_{SP}; \text{ or} \quad \text{(IVA)}$$

$$(D_{PST})^B = (q_i) \times (1/A) \times C_{TRANS} \times (d_{prop}^2) \times (1/\mu_{fluid}) \times (\Delta SG_{PS}) \quad \text{(IVB)}$$

wherein:

A is the multiplier from the Power Law equation describing the velocity of transport slurry vs. distance for the fracture geometry;

B is the exponent from the Power Law equation describing the transport slurry velocity vs. distance for the fracture geometry; and $q_i$ is the injection rate per foot of injection height, bpm/ft.

Thus, increasing the magnitude of the $I_{SP}$ value relates to a corresponding increase in difficulty in proppant transport.

Equation 7 may further be used to determine, prior to introducing a transport slurry into a fracture having a defined generalized geometry, the requisite injection rate for the desired propped fracture length. This may be obtained in accordance with Equation (V):

$$q_i=[1/(D_{PST})^B]\times[(1/A)\times C_{TRANS}\times(d^2_{prop})\times(1/\mu_{fluid})\times(\Delta SG_{PS})] \quad \text{(V)}$$

Further, $\Delta SG_{PS}$ may be determined for the desired propped fracture length, prior to introducing a transport slurry into a fracture of defined generalized geometry in accordance with Equation (VI):

$$\Delta SG_{PS}=(A)\times(1/q_i)\times(D_{PST})^B\times(1/C_{TRANS})\times(1/d^2_{prop})\times(\mu_{fluid}) \quad \text{(VI).}$$

Still, the requisite apparent viscosity of the transport fluid for a desired propped fracture length may be determined prior to introducing a transport slurry into a fracture of defined generalized geometry in accordance with Equation (VII):

$$\mu_{fluid}=(1/A)\times(q_i)\times(1/D_{PST})^B\times(C_{TRANS})\times(\Delta SG_{PS})\times(d^2_{prop}) \quad \text{(VII)}$$

Lastly, the requisite median diameter of a proppant, $d_{prop}$, for the desired propped fracture length may be determined prior to introducing the transport slurry into a fracture of defined generalized geometry in accordance with Equation (VIII):

$$(d_{prop})^2=(A)\times(1/q_i)\times(D_{PST})^B\times(1/C_{TRANS})\times(1/\Delta SG_{PS})\times(\mu_{fluid}) \quad \text{(VIII)}$$

Using the relationships established, placement of proppants to near limits of a created fracture may be effectuated.

The model defined herein is applicable to all transport fluids and proppants. The model finds particular applicability where the transport fluid is a non-crosslinked fluid. In a preferred embodiment, the transport fluid and proppant parameters are characterized by a fluid viscosity between from about 5 to about 60 cP, a transport fluid density from about 8.34 to about 10.1 ppg, a specific gravity of the proppant between from about 1.08 to about 2.65 g/cc and median proppant diameter between from about 8/12 to about 20/40 mesh (US).

The description herein finds particular applicability in slurries having a viscosity up to 60 cP, up to 10.1 ppg brine, 20/40 mesh to 8/12 mesh proppant size and specific gravities of proppant from about 1.08 to about 2.65. The mathematical relationships have particular applicability in the placement of ultra lightweight proppants, such as those having an specific gravity of less than or equal to 2.45 as well as slickwater fracturing operations.

The following examples are illustrative of some of the embodiments of the present invention. Other embodiments within the scope of the claims herein will be apparent to one skilled in the art from consideration of the description set forth herein. It is intended that the specification, together with the examples, be considered exemplary only, with the scope and spirit of the invention being indicated by the claims which follow.

EXAMPLES

Example 1

The distance a transport fluid containing a proppant comprised of 20/40 ULW proppant having an specific gravity of 1.08 and 29 cP slickwater would be transported in a fracture having a 3:1 length to height geometry with a 1 bpm/ft injection rate was obtained by first determining the minimum horizontal velocity, $MHV_{ST}$, required to transport the proppant in the slickwater:

$$MHV_{ST} = C_{TRANS} \times (d_{prop}^2) \times (1/\mu_{fluid}) \times (\Delta SG_{PS}); \text{ or}$$

$$MHV_{ST} = (1150) \times (C_{TRANS}) \times (0.5810) \times (1/29) \times (1.08 - 1.00) = 0.022 \text{ ft/sec.}$$

The distance was then required by as follows:

$$D_{PST}^{B} = MHV_{ST}/A$$

wherein A for a 3:1 length to height geometry is 5261.7 and B is −2.2412; or $$D_{PST}^{-2.2412} = 0.022/5261.7;$$

$$D_{PST} = 251 \text{ ft.}$$

Example 2

The distance a transport fluid containing a proppant comprised of 20/40 Ottawa sand and 7 cP 2% KCl brine would be transported in a fracture having a 3:1 length to height geometry with a 1 bpm/ft injection rate was obtained by first determining the minimum horizontal velocity, $MHV_{ST}$, required to transport proppant in the slickwater as follows:

$$MHV_{ST} = C_{TRANS} \times (d_{prop}^2) \times (1/\mu_{fluid}) \times (\Delta SG_{PS}); \text{ or}$$

$$MHV_{ST} = (1150) \times (C_{TRANS}) \times (0.4032) \times (1/7) \times (2.65 - 1.01) = 1.27 \text{ ft/sec.}$$

wherein the 1150 multiplier is a unit conversion factor.

The distance was then determined as follows:

$$D_{PST}^{B} = MHV_{ST}/A$$

wherein A for a 3:1 length to height geometry is 5261.7 and B is −2.2412; or $$D_{PST}^{-2.2412} = 1.27/5261.7;$$

$$D_{PST} = 41 \text{ ft.}$$

Example 3

For a transport fluid containing a proppant having the following properties:

Proppant diameter: 0.635 mm
Specific gravity of proppant: 1.25
Fluid viscosity: 30 cP
Specific gravity of transport fluid: 1.01 the propped fracture length, $D_{PST}$, for a fracture having a 3:1 length to height geometry with a 5 bpm/ft injection rate was determined as follows:

$$(D_{PST})^B = (q_i) \times (1/A) \times (c_{TRANS}) \times 1150 \times (d_{prop}^2) \times (1/\mu_{fluid}) \times (\Delta SG_{PS})$$

$$(D_{PST})^B = (5) \times (1/5261.7) \times (0.117) \times (0.635)^2 \times (1/30) \times (1.25 - 1.01)$$

$$D_{PST} = 90.4 \text{ ft.}$$

Example 4

The fluid viscosity for slickwater which would be necessary to transport 20/40 ULW proppant having an specific gravity of 1.25 100 feet from the wellbore using a transport fluid comprised of 20/40 ULW-1.25 proppant was determined by assume a fracture having a 3:1 length to height geometry and a 5 bpm/ft injection rate as follows:

$$\mu_{fluid} = (1/A) \times (q_i) \times (1/D_{PST})^B \times (C_{TRANS}) \times (\Delta SG_{PS}) \times (d_{prop}^2)$$

$$\mu_{fluid} = (1/5261.7) \times (5) \times (1/100)^{-2.2412} \times (0.0117) \times (\Delta SG_{PS}) \times (0.4264^2)$$

$$\mu_{fluid} = 37.6 \text{ cP}$$

From the foregoing, it will be observed that numerous variations and modifications may be effected without departing from the true spirit and scope of the novel concepts of the invention.

What is claimed is:

1. A method of hydraulic fracturing a subterranean formation by introducing a transport fluid containing a proppant into a fracture of defined generalized geometry within the formation, the method comprising:

(a) determining the requisite injection rate, $q_i$, for the desired propped fracture length of the fracture, $D_{PST}$, in accordance with Equation (I):

$$(q_i) = [1/(D_{PST})^B] \times [(1/A) \times C_{TRANS} \times (d^2_{prop}) \times (1/\mu_{fluid}) \times (\Delta SG_{PS})] \quad \text{(I)}$$

wherein:

A is the multiplier and B is the exponent from the Power Law equation of velocity of the transport slurry vs. distance for the fracture geometry;

$C_{TRANS}$ is the transport coefficient;

$d_{prop}$ is the median proppant diameter, in mm.;

$\mu_{fluid}$ is the apparent viscosity of the transport fluid, in cP; and $\Delta SG_{PS}$ is $SG_{prop}-SG_{fluid}$, $SG_{prop}$ being the specific gravity of the proppant and $SG_{fluid}$ being the specific gravity of the transport fluid;

(b) introducing the transport fluid into the formation; and (c) subjecting the formation to hydraulic fracturing at the injection rate, $q_i$, and creating fractures in the formation defined by $D_{PST}$.

2. The method of claim 1, wherein the proppant is an ultra lightweight (ULW) proppant.

3. The method of claim 1, wherein the transport fluid is slickwater.

4. The method of claim 1, wherein the fracture geometry has a 1:1 to 5:1 aspect ratio.

* * * * *